United States Patent [19]

Schaming

[11] 4,247,047

[45] Jan. 27, 1981

[54] MODULAR ZONED DIGITAL COOLANT CONTROL SYSTEM FOR STRIP MILL ROLLS

[76] Inventor: Edward J. Schaming, P.O. Box 1070, Butler, Pa. 16001

[21] Appl. No.: 3,345

[22] Filed: Jan. 15, 1979

[51] Int. Cl.[3] ..... B05B 1/16

[52] U.S. Cl. ..... 239/391; 72/201; 134/198; 137/884; 164/444; 239/436; 239/551; 239/556; 239/557; 239/562

[58] Field of Search ..... 164/414, 444; 72/201; 266/113, 114; 137/884; 134/172, 198; 239/390, 391, 436, 536, 551, 556, 557, 560, 561, 562, 583, 585, 600, 548

[56] References Cited

U.S. PATENT DOCUMENTS

| | | | |
|---|---|---|---|
| 3,570,725 | 3/1971 | Baker et al. | 239/551 X |
| 3,784,153 | 1/1974 | MacDonald et al. | 72/201 X |
| 3,880,358 | 4/1975 | Schaming | 239/551 |
| 4,152,202 | 5/1979 | DeLight | 239/551 X |

*Primary Examiner*—Andres Kashnikow
*Attorney, Agent, or Firm*—D. Paul Weaver

[57] ABSTRACT

Metal strip reducing rolls are precisely cooled in multiple zones across the width of the strip by the selective activity of modular valve assemblies on coolant headers mounted near the reducing rolls. Each valve module may possess one or more remotely controllable coolant control valves within the header and associated coolant nozzles whose aperture sizes may vary in a fixed ratio within each zone to achieve a variable coolant flow rate in each zone while maintaining a constant unchanging coolant spray configuration and impingement force. Individual coolant valves and nozzles in a digital control system are fully on or fully off in contrast to gradient control of coolant in an analog system. An observer of the moving metal strip activates and deactivates selected nozzles in selected zones across the strip through a push button digital control console. Electrical, pneumatic or hydraulic valve control may be utilized. Back-up rolls in the mill may also be cooled.

7 Claims, 12 Drawing Figures

FIG. 6
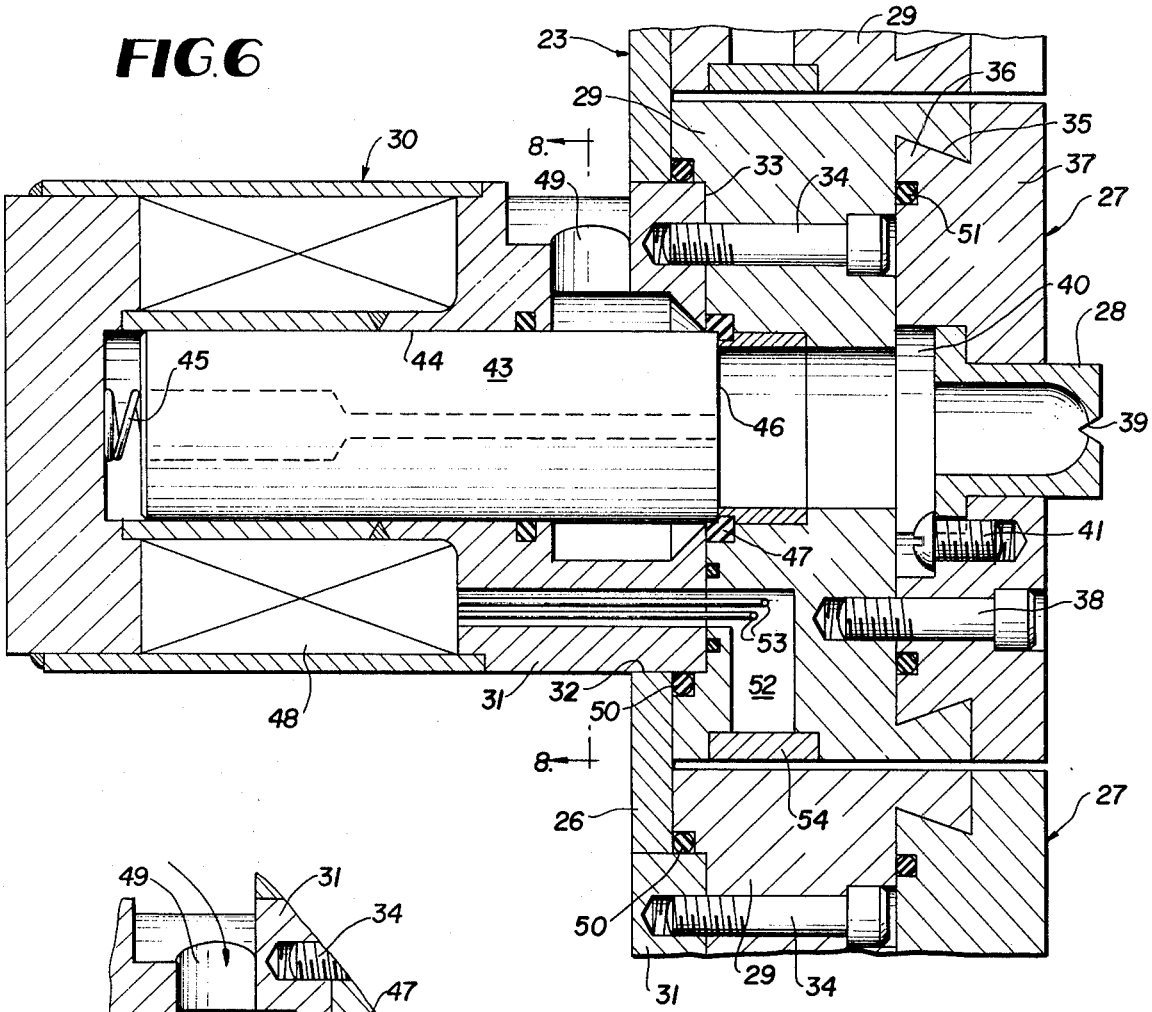
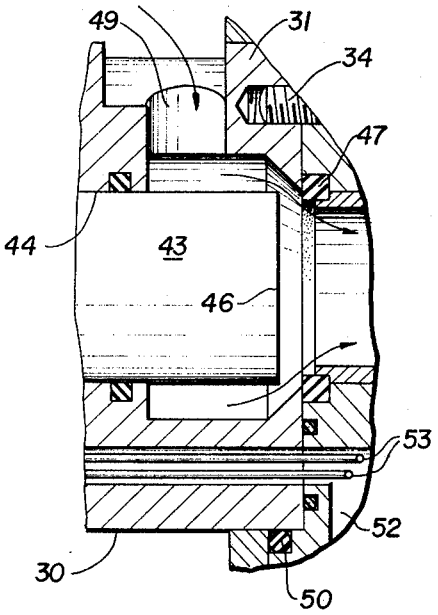
FIG. 7
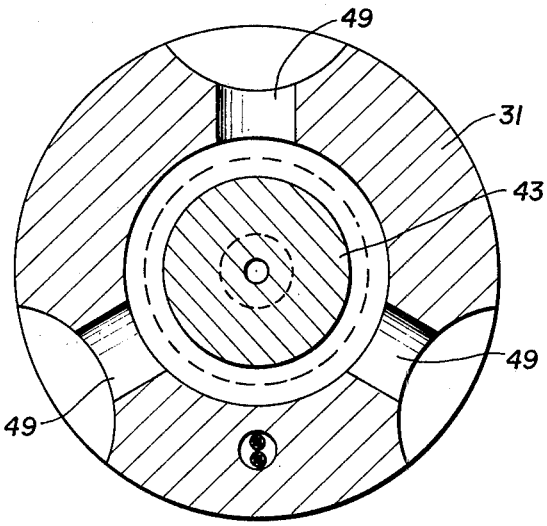
FIG. 8

MODULAR ZONED DIGITAL COOLANT CONTROL SYSTEM FOR STRIP MILL ROLLS

BACKGROUND OF THE INVENTION

A variety of cooling arrangements for reducing rolls in metal strip rolling mills are known in the prior art. The prior art systems are widely varied in complexity and cost of manufacturing and they also vary in effectiveness and operational efficiency. Examples of the known prior art noted herein under 37 C.F.R. 1.56 are shown in the following U.S.Pat. Nos.

| | |
|---|---|
| 1,335,267 | 3,648,996 |
| 1,384,085 | 3,684,177 |
| 3,400,891 | 3,766,763 |
| 3,510,065 | 3,779,054 |
| 3,514,984 | 3,784,153 |
| 3,570,725 | 3,877,510 |
| 3,587,265 | 3,880.358 |
| 3,589,160 | 3,905,216 |
| 3,606,162 | 3,990,284 |
| 3,629,015 | 4,081,141 |

The objective of the invention is to provide a highly reliable and efficient zoned digitally controlled coolant flow system for the reducing rolls of metal strip mills. The apparatus involved in the invention includes unitized coolant headers which are installed at the most advantageous locations relative to rolls requiring cooling during the reducing of metal strips. Each coolant header carries a required number of valve assembly modules and each such module may carry one or several remotely controllable valves and associated coolant spray nozzles whose aperture sizes in a given module of the apparatus can differ in a fixed area ratio such as 2 to 1, 4 to 1, and 8 to 1. This gradation of nozzle aperture size in the individual coolant zones of the digital system enables a widely changeable coolant flow rate in any or all zones varying between on or off for a single control valve and nozzle to as much as a 15 to 1 flow rate change where four valves and nozzles are present in each module of the apparatus corresponding to each zone requiring cooling. In any chosen array of valves and nozzles per modular unit of the system, selected valves and nozzles are fully on or fully off without analog or gradient control of the coolant flow. This assures within the system that a constant unchanging coolant spray configuration is maintained with a constant full coolant spray impingement force against the face of the roll undergoing controlled cooling in multiple zones.

Where electrically operated coolant control valves are employed, the valve modules are prewired and equipped with individual quick disconnect receptacles. At an appropriate point or points on each coolant header, a further connector for the wiring of multiple modules is provided for coupling to the main control cable extending to the remote push button digital control console or panel. The invention is also compatible with pneumatic or hydraulic valve control means, and pneumatic control tubes for the valves of individual modules can be preassembled in the same spaced provided for wiring.

In the overall, the invention is characterized by simplicity, compactness and rugged durability to withstand the rigors of rolling mill environment. It is designed for ease and economy of maintenance, and on a comparative basis with the prior art is economical to manufacture and install. Most importantly, the invention is thought to possess a flexibility of operation within multiple zones which is beyond the capability of the known prior art.

Various features and advantages of the invention beyond those already mentioned will become apparent during the course of the following description.

BRIEF DESCRIPTION OF THE DRAWINGS

FIG. 6 is a further enlarged fragmentary horizontal section taken on line 6—6 of FIG. 5.

FIG. 7 is a fragmentary section through one coolant flow control valve in a full open position.

FIG. 8 is a transverse vertical section taken on line 8—8 of FIG. 6.

DETAILED DESCRIPTION

Figure 1:
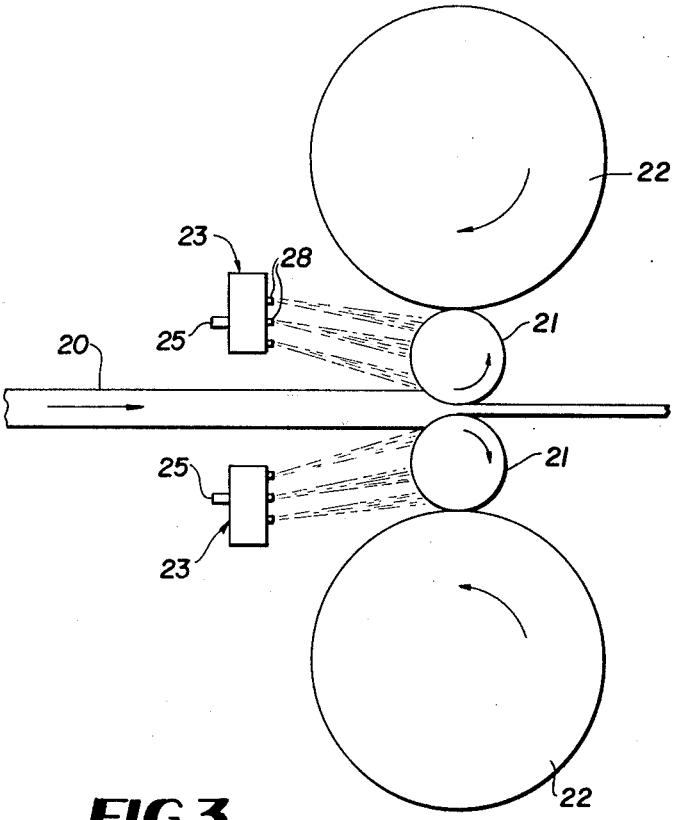
FIG. 1 is a partly schematic side elevation of the invention.

Referring to the drawings in detail wherein like numerals designate like parts, a metal strip 20 undergoing reduction in a rolling mill is in thermal contact with and transmits heat generated in the reduction process to the reduction rolls 21 of the mill and, to a lesser extent, to the usual back-up rolls 22.

A coolant header 23 in accordance with the invention is arranged on each side of the metal strip 20 and at least on one side of the two reduction rolls 21, such as the upstream side, as illustrated in the drawings. In some cases, additional coolant headers 23 may be placed downstream from the rolls 21 or may be positioned to cool the back-up rolls 22 of the mill. The invention is very flexible in this regard to meet varying requirements in the field. The unit construction of the headers 23 makes it a comparatively simple matter to add or remove headers from the system or to reposition headers. Also, the modular construction of each header to be described in detail renders maintenance work quite simple, as individual coolant valve assemblies or modules can readily be removed for repair and new modules plugged into the headers. Generally, the physical construction of each header 23 is very similar to the construction disclosed in prior U.S. Pat. No. 3,880,358, issued Apr. 29, 1975, to Schaming.

Figure 11:
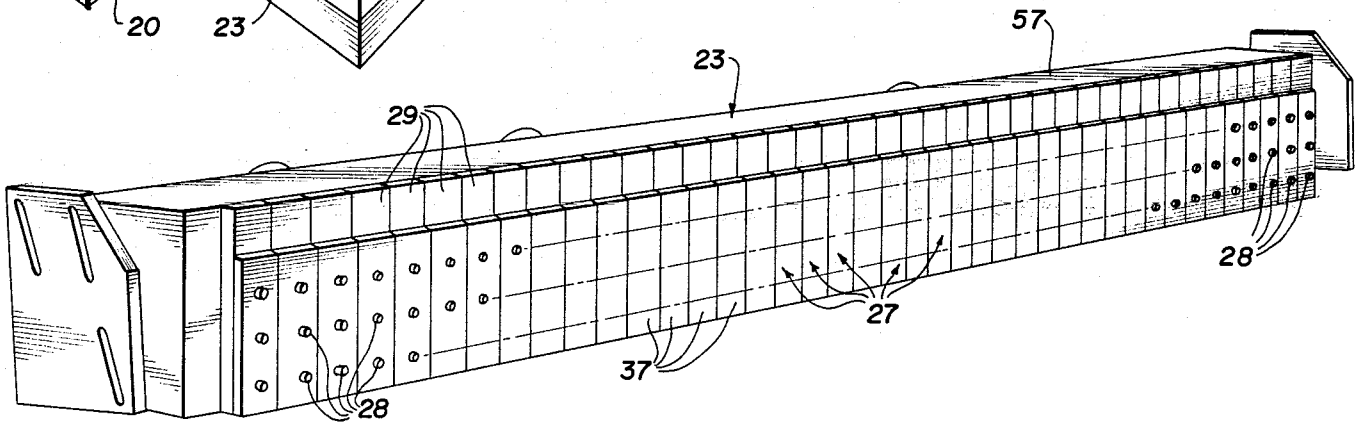
FIG. 11 is a front perspective view of a coolant header and multiple valve modules.

Each coolant header 23 comprises a hollow generally rectangular cross section body portion 24 of the necessary length to suit the needs of a given installation. Each header has a main inlet 25 for the liquid coolant, water, supplied under pressure from any available source as disclosed in U.S. Pat. No. 3,880,358. On the forward wall 26 of each header 23, a plurality of coolant control valve and nozzle assemblies or modules 27 are mounted in side-by-side relation. The number of the modules 27 will also vary from installation-to-installation, and in a practical embodiment of the invention shown in FIG. 11, as many as forty or more modules 27 may be utilized on each header. The coolant spray nozzles 28 of the modules 27 are typically on two inch centers across the header but this spacing could be varied somewhat in particular cases. The individual assemblies or modules 27 are easily demountable from the header 23 for servicing or replacement when required and this feature is one of the main advantages of the invention.

Figure 5:
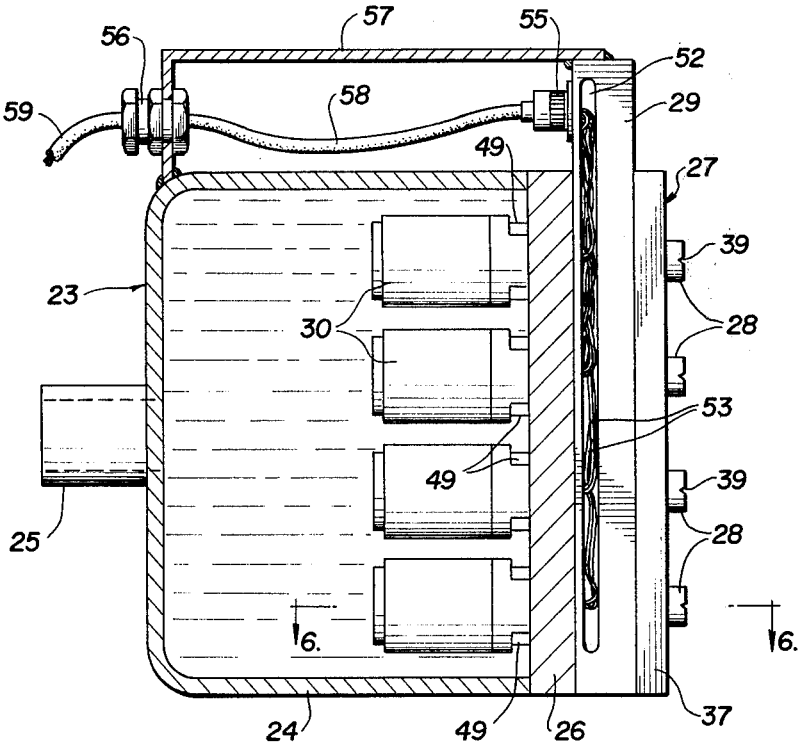
FIG. 5 is an enlarged fragmentary vertical section taken on line 5—5 of FIG. 4.

As best illustrated in FIGS. 5 and 6, each module 27 consists of a valve mounting bar 29 capable of supporting one or more coolant flow control valves 30 in a vertical row on the bar 29, one, two or up to four or more valves 30 and associated nozzle 28 can be provided on each module 27, as required and here again the versatility of the invention is apparent. The valves 30 can be electrically operated, as illustrated, or in some cases can be pneumatically or hydraulically operated with very little change in the construction of the system.

Each individual valve 30 comprises a frame 31 of cylindrical cross section which is received through an opening 32 in the header front wall 26 and projects into a registering cavity 33 of the valve mounting bar 29, FIG. 6. Screws 34 mounted in openings of the bar 29 are threadedly engaged with the valve frame 31 to secure the latter to the mounting bar 29. Additional screws, not shown, in a different plane from the screws 34 secure each bar 29 to the front wall 26 of the header 23.

In its forward face, each mounting bar 29 has a dovetailed groove 35 extending for the entire length of the bar and a cooperating dovetailed tongue 36 is provided on a spray nozzle bar or retainer 37 forming a part of each module 27. The tongue 36 is slidably received within the groove 35 and the nozzle retainer 37 is releasably secured in assembled relationship with the bar 29 by another set of screws 38 engaged through openings of the retainer 37. The construction is similar to that disclosed in U.S. Pat. No. 3,880,358. Each retainer 37 carries one or more of the coolant spray nozzles 28, as previously noted.

Each nozzle 28 has a spray aperture 39 formed therein and the sizes of the apertures 39 in a group of nozzles for each module 27 may be different from the other apertures of the group in a way and for a reason to be fully described.

Each nozzle 28 is held in a retainer cavity 40 of the retainer 37 by a single locator screw 41 which fixes the nozzle on the retainer and positions the angle of the aperture or slot 39 in such a way that the coolant sprays emitted by adjacent nozzles in the side-by-side modules 27 will be non-interfering during operation while fully covering and cooling the peripheries of the reduction rolls 21.

Figure 2:
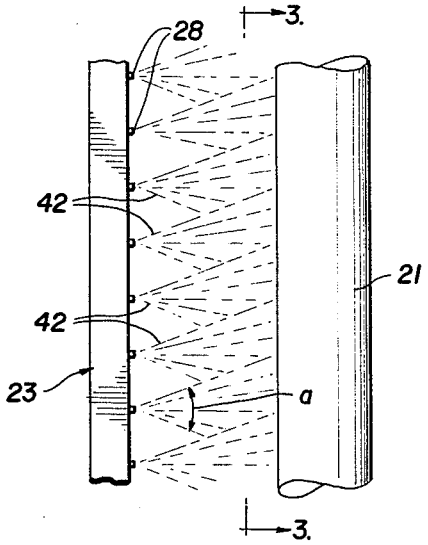
FIG. 2 is a fragmentary plan view thereof.
Figure 3:
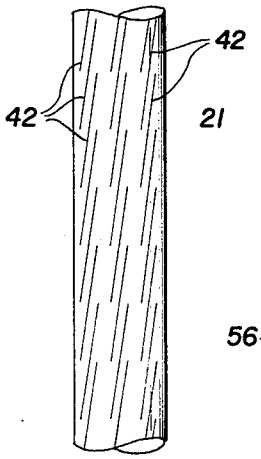
FIG. 3 is a fragmentary side elevation of a reducing roll showing the coolant spray pattern in multiple zones along the roll including the overlapping non-interfering arrangement of coolant sprays.
Figure 10:
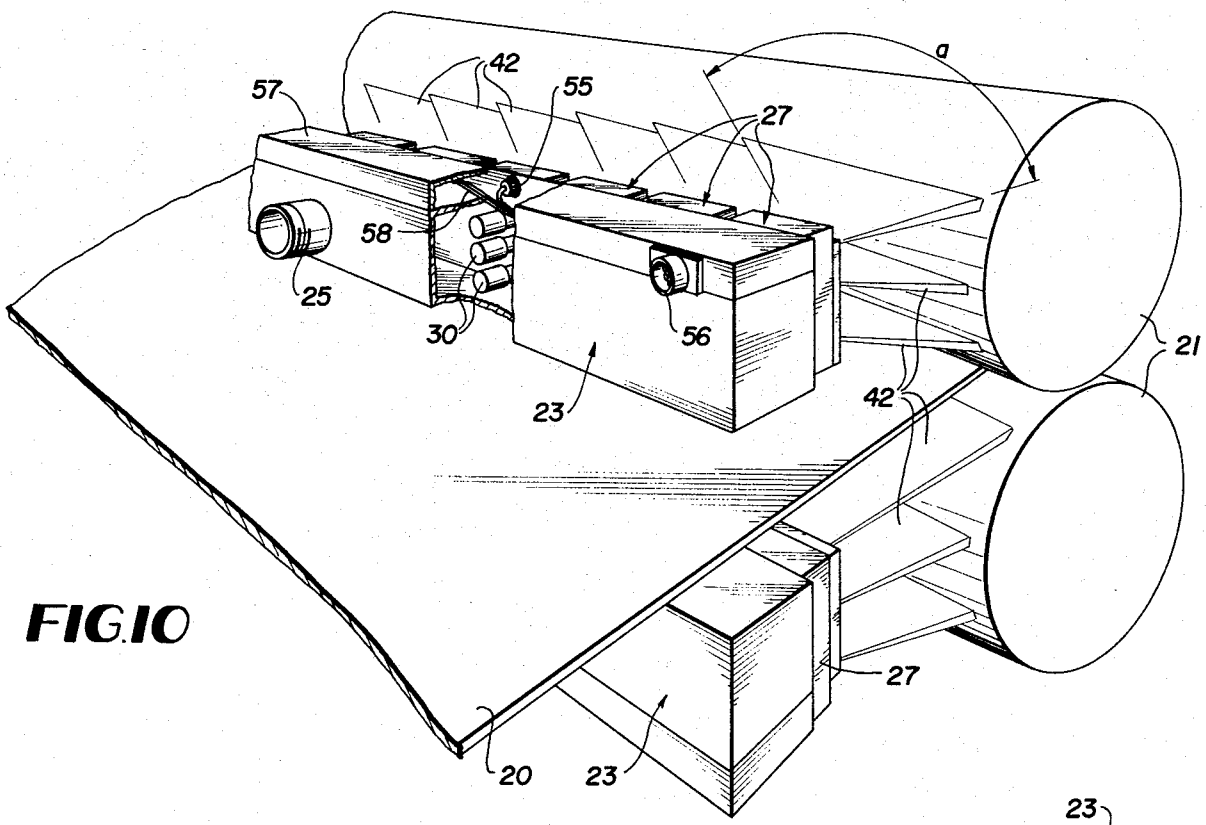
FIG. 10 is a fragmentary rear perspective view of the invention.

In FIGS. 2, 3 and 10, the coolant sprays 42 emitted by the nozzles 28 of the several modules 27 are illustrated. As the drawings show, the sprays 42 of adjacent modules 27 overlap in shingled fashion without physical interference due to the spacing and angularity of the sprays established by the locator screws 41. This spray pattern is an important factor in the improved cooling of the rolls 21 achieved by the invention. Another important feature contributing to improved cooling is that the digital control of nozzle activity, to be described, assures that the sprays 42 are either fully on or fully off in the system with no intermediate or gradient adjustment of spray volume or pressure. Consequently, the spray angle a of every spray in the system is constant and non-changing and the impingement force of each spray 42 against the roll 21 is constant and full for each nozzle 28 which is activated by the digital control system. These factors contribute greatly to improved cooling and in the refinement of cooling control across the multiple zones of each header 23 and associated roll 21. That is to say, each control valve and nozzle module 27 defines a separate and distinct coolant zone across the roll 21 which may be finely regulated by the selective cutting in or cutting out of one or more, or all, of the spray nozzles 28 of each separate module 27 by operation of the associated valve 30 between a fully open and a fully closed position.

In this regard, each valve 30 additionally comprises an armature 43 slidable within a bore 44 of the valve frame 31. Each armature is urged by a spring 45 to a valve closing position, FIG. 6, where a shoulder 46 of the armature sealingly engages and compresses an elastic valve seal 47 held in a seating recess of the bar 29. Each valve 30 has an electro-magnetic coil 48 which, when energized, causes retraction of the armature 43 to separate the shoulder 46 from the valve seal 47 to fully open the valve and admit coolant to the cavity 40 and spray nozzle 28.

As shown in FIGS. 5 and 6, the valves 30 project rearwardly of the wall 26 into the hollow header body 24 which is maintained full of water under pressure when the system is in operation. To allow the water or coolant to pass through each valve and nozzle 28, the valve frame 31 has plural radial coolant inlet ports 49 formed therein in open communication with the interior of the header chamber. Hence, when each valve armature 43 is opened or unseated by energizing the adjacent coil 48, coolant from the header chamber can flow freely to the particular nozzle 28 of the control valve with which it is associated on the module 27, which module may include one, two or even four or more valves and nozzles, as discussed.

Each valve mounting bar 29 is sealed against the header front wall 26 by an O-ring seal or seals 50 generally in accordance with the disclosure of Pat. 3,880,358. Similarly, each nozzle retainer 37 is sealed with relation to the bar 29 by another O-ring seal 51. Other conventional seals are provided in the system as shown in FIG. 6 and need not be described in further detail.

Another important feature of the invention is the ability of each separable module 27 to be prewired and electrically coupled with a wiring harness or cable of each header 23 by quick disconnect means. More particularly, each bar 29 has a side cavity 52 for the wires 53 of the coils of the several electrically operated valves 30 of each module 27. After wiring, each cavity 52 may be closed by a cover plate 54 as shown in FIG. 6. Each module 27 has a quick disconnect electrical coupling 55 secured to the rear of the bar 29, FIGS. 5 and 10. The quick disconnect couplings 55 are also shown schematically in FIG. 4. At an appropriate point or points on each header 23, a main electrical coupling 56 is also provided, preferably on the rear of an upper protective cover plate 57 whose purpose is to protect the wiring 58 between the individual module connectors 55 and the main connector 56 which is electrically connected to a main cable 59 leading to a electrical digital control console 60 for the coolant valves 30 of the entire system. The console or panel 60 per se is conventional and the details of its operation are not essential to a proper understanding of the invention. Suffice it to say that columns of push buttons 61 on the console 60 control the opening and closing of selected valves 30 in each module 27 of the system, which, as stated, can include one or several valves 30 and associated nozzles 28 having varying nozzle aperture sizes. A human observer of the moving metal strip 20 can visually detect conditions which call for greater cooling, lesser cooling or no cooling in a particular zone or zones across the strip corresponding to the lateral locations of the modules 27 and their spray nozzles 28. Consequently, the operator can press selected buttons 61 of the console to selectively open or close particular valves 30 of the system in any required manner. Through this digital control arrangement, the valves in certain zones can be completely closed or completely open or certain valves in one or more zones corresponding to modules 27 can be completely opened or closed. Therefore, the system provides a very refined and highly flexible regulation of the coolant sprays which are to be directed at a given time onto different zones of the reducing rolls 21. The operation of the valves and spray nozzles can be continually changed by the attendant or operator at the console 60. It may be noted that the console 60 also contains columns of push buttons 62 for valves and nozzles of additional headers used to cool back-up rolls 22 when such headers are necessary.

Figure 4:
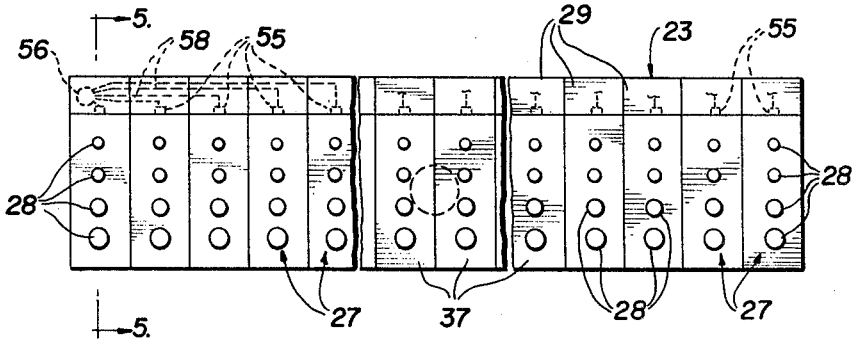
FIG. 4 is a partly schematic fragmentary front elevation of a coolant header and multiple modular valve units thereon.
Figure 9:
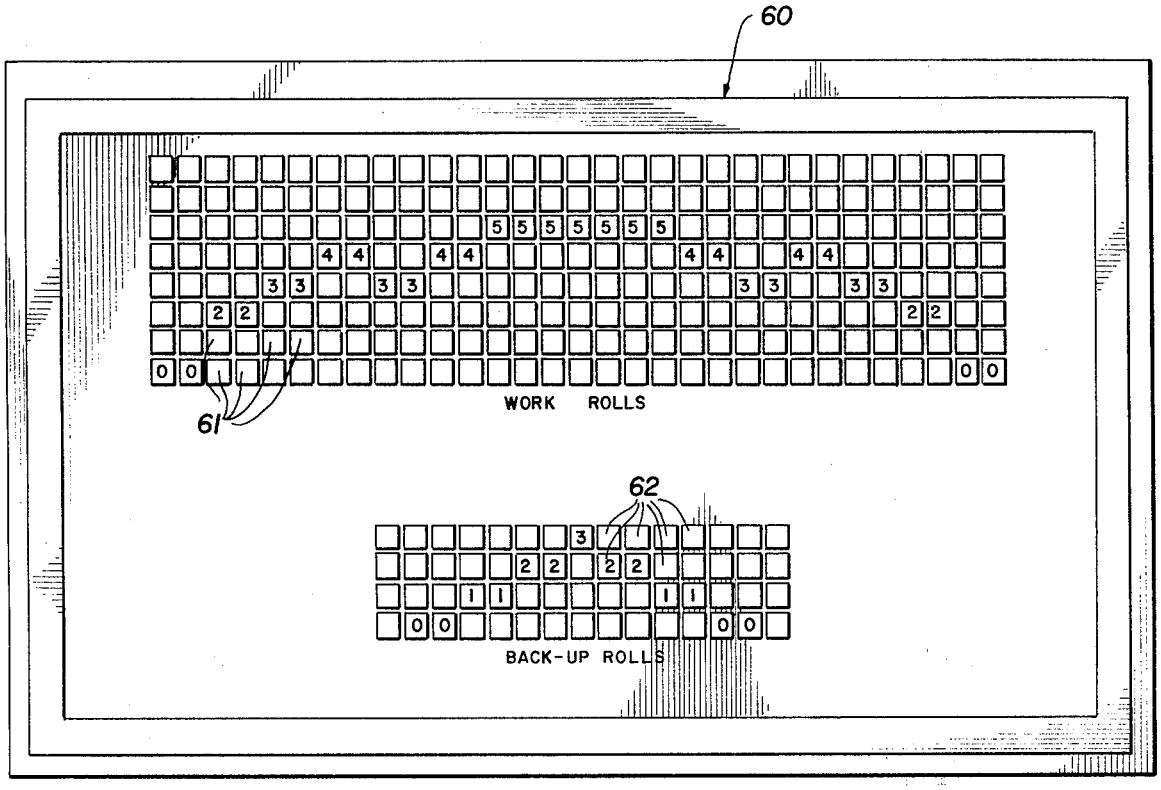
FIG. 9 is a front elevation of a digital control console.

A unique and important aspect of the invention already mentioned briefly is the arrangement whereby not only the number of nozzles 28 on each module or assembly 27 may be varied from one to four or more, but also the nozzle aperture or slot size may be varied. This is schematically shown in FIG. 4 where the modules 27 are shown as having four nozzles 28 each and four valves 30, not shown. From top to bottom in each zone or module of FIG. 4, the nozzle apertures increase progressively in size. For a given aperture size across the top row of apertures in FIG. 4, the next lowermost row of apertures are twice the size or area of the top row, the next lowermost horizontal row of apertures, namely the third row down, are four times the size of the apertures in the top row, and the bottom row apertures are eight times the size of those apertures in the top row.

With this variable arrangement of nozzle aperture sizes on the modules 27 and with the ability of each module to utilize one or more nozzle and valve assemblies under selective control from the console 60 to fully open or fully close any valve or valves of the system, a very flexible control of coolant flow in any selected zone or zones of the system is attainable. The following table illustrates the coolant flow rate turn-down ratios available in a system as illustrated by FIG. 4:

| No. of Control Valve and Nozzle Assemblies per Module 27 | Coolant Flow Rate Changes Attainable in Equal Increments |
|---|---|
| 1 | on-off |
| 2 | 3 to 1 |
| 3 | 7 to 1 |
| 4 | 15 to 1 |

In addition to the available coolant flow rate changes or ratios, further refined control of cooling in the system is inherently present because of the fact that the activated coolant sprays 42 always have the same spray angle a and always have the same full impingement force against the roll 21 undergoing cooling in selective zones. At no time does the system increase or lessen the force of the sprays 42 or change the spray angles or patterns except to fully turn off selectively certain sprays by means of the control console 60.

Figure 12:
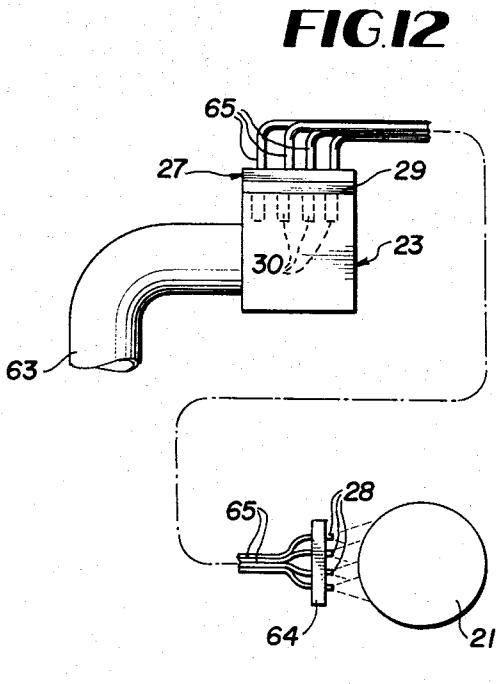
FIG. 12 is a fragmentary partly schematic side elevation showing a modification of the invention.

In most cases, it is desirable to mount the valves 30 and nozzles 28 directly on the header 23 to produce a unit assembly for positioning near the roll 21 requiring cooling. In fact, this is one of the features and objectives of the invention. However, in certain cases, it may be preferable to mount the header 23 and the valves 30 remote from the rolls 21, and place the nozzles close to the rolls. In such situations, as illustrated in FIG. 12 of the drawings, coolant is supplied through a conduit 63 to the header 23 located remotely from the associated roll 21. The modules 27 including the control valves 30 are mounted on the header 23 substantially in the described manner. However, a separate support plate 64 for the coolant spray nozzles 28 is installed near the reducing roll 21 and the nozzle or nozzles 28 are connected to the control valves 30 of the header by pipes or tubes 65 of whatever lengths required. By virtue of this arrangement, the header or headers 23 may be placed outside of the mill and only the nozzles 28 and their holder placed in the mill. The arrangement further increases the capabilities of the invention.

As noted previously, the most efficient and controllable cooling of the rolls 21 can take place when the cooling spray angle a is constant and the spray impingement force against the roll is constant. These conditions prevail in the invention regardless of how many of the spray nozzles are turned off or turned on fully in particular zones. In prior art systems utilizing analog or gradient control of the coolant sprays, as by partly opening spray nozzle control valves, the spray angle a will change and the spray impingement force will fluctuate. This phenomenon occurs because of the simple relationship between flow (F), gpm, pressure, psi, and spray nozzle orifice area which is a constant (C). The controlling expression is:

$$F=C\sqrt{P}$$

In this expression, the spray angle a and spray impingement force will remain firm only through a flow rate change of about 2 to 1, and beyond this, the spray angle will change as will the impingement force and this is why a system using gradient control as distinguished from digital, off-on control, cannot achieve the results of the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A coolant distribution apparatus for the zoned cooling of rolls in a metal strip rolling mill comprising a coolant header having a coolant chamber and a coolant inlet leading to said chamber, plural modular coolant control valve and spray nozzle assemblies releasably mounted on said header, each modular assembly having a predetermined number of independently digitally operated control valves and associated coolant spray nozzles, the spray nozzles of each modular assembly having predetermined nozzle aperture sizes, digital power means connected with said control valves in said modular assemblies so that the valves in any or all assemblies may be selectively fully opened or fully closed to achieve the desired zoned cooling of said rolls, said digital power means being electrical, and each coolant control valve having an electromagnetic coil and a movable armature forming a valve element engageable with a seat in the particular modular assembly containing such valve, wiring for all of the control valves of each modular assembly being contained within each modular assembly, and a common electrical connector on each modular assembly for the wiring contained therein.

2. A coolant distribution apparatus as defined in claim 1, and each modular assembly comprising a common mounting bar for the coolant control valves of the assembly, said wiring being disposed in a cavity of said mounting bar and extending to the coils of the valves in the assembly, and a common retainer for the spray nozzles of the assembly and releasably coupled to said mounting bar.

3. A coolant distribution apparatus as defined in claim 2, and said common retainer for said spray nozzles being remotely spaced from said header and near the roll of the mill being cooled, and coolant conduit means connected between said retainer and said modular assemblies.

4. A coolant distribution apparatus as defined in claim 2, and said common retainer having plural nozzle mounting openings therein, and a securing and locator element for each nozzle within each opening of the retainer so that the spray apertures of all of the nozzles can be arranged at a fixed common angle whereby the nozzle sprays will overlap each other in shingled fashion without interference during the operation of the apparatus.

5. A coolant distribution apparatus as defined in claim 1, and at least one master connector on the coolant header electrically coupled with a cable harness leading from the common electrical connector of each modular assembly and also electrically coupled with cable means of said digital electrical power means.

6. A coolant distribution apparatus as defined in claim 5, and said digital electrical power means including a remotely located control console having selectively operable switch means.

7. A coolant distribution apparatus as defined in claim 5, and a protective panel member on the coolant header overlying said cable harness and the common electrical connectors of the modular assemblies and serving to support said master connector.

* * * * *